US009462919B2

(12) United States Patent
Murphy et al.

(10) Patent No.: US 9,462,919 B2
(45) Date of Patent: Oct. 11, 2016

(54) DAMPER LOCKING MECHANISM FOR TOILET SEAT

(71) Applicant: Kohler Co., Kohler, WI (US)

(72) Inventors: Roger W. Murphy, Kohler, WI (US); Jeffrey T. Laundre, Sheboygan, WI (US); David Ourada, Sheboygan, WI (US)

(73) Assignee: KOHLER CO., Kohler, WI (US)

( * ) Notice: Subject to any disclaimer, the term of this patent is extended or adjusted under 35 U.S.C. 154(b) by 156 days.

(21) Appl. No.: 14/143,538

(22) Filed: Dec. 30, 2013

(65) Prior Publication Data

US 2014/0189947 A1 Jul. 10, 2014

Related U.S. Application Data

(60) Provisional application No. 61/750,135, filed on Jan. 8, 2013.

(51) Int. Cl.
*A47K 13/12* (2006.01)
*A47K 13/10* (2006.01)

(52) U.S. Cl.
CPC ..... *A47K 13/12* (2013.01); *A47K 13/10* (2013.01)

(58) Field of Classification Search
CPC ..... A47K 13/12; A47K 13/10
USPC ..... 4/248
See application file for complete search history.

(56) References Cited

U.S. PATENT DOCUMENTS

| | | | | |
|---|---|---|---|---|
| 2,787,006 | A | 4/1957 | Young | |
| 4,491,989 | A | 1/1985 | McGrail | |
| 4,639,147 | A | 1/1987 | Schwarz | |
| 5,193,228 | A | 3/1993 | Murasawa et al. | |
| 5,769,188 | A * | 6/1998 | Okabe et al. | 188/82.84 |
| 6,178,597 | B1 * | 1/2001 | Suzuki et al. | 16/330 |
| 6,182,301 | B1 | 2/2001 | Krueger et al. | |
| 6,393,624 | B1 | 5/2002 | Iwashita | |
| 6,687,921 | B1 | 2/2004 | Li | |
| 7,712,157 | B2 | 5/2010 | Laundre | |
| 7,845,027 | B2 | 12/2010 | Er | |
| 2008/0060120 | A1 | 3/2008 | Er | |
| 2010/0083431 | A1 | 4/2010 | Hallett | |
| 2010/0146689 | A1 | 6/2010 | Yang | |

FOREIGN PATENT DOCUMENTS

| | | | |
|---|---|---|---|
| CN | 101087551 | A | 12/2007 |
| CN | 201379501 | Y | 1/2010 |
| EP | 2474257 | A1 | 7/2012 |
| JP | 04-050524 | A | 2/1992 |

* cited by examiner

*Primary Examiner* — Janie Loeppke
(74) *Attorney, Agent, or Firm* — Foley & Lardner LLP

(57) ABSTRACT

A toilet includes a seat, a bowl and a damper locking mechanism that allows the seat to rotate relative to the bowl with an influenced inertia. The damper locking mechanism includes a hinge base having a biasing member and an interior surface that defines a bore and a damper having an exterior surface that engages the interior surface. When the damper is disposed in the bore, the biasing member imparts a radial force to bias the damper into the hinge base and remove a looseness between the seat and the bowl.

20 Claims, 10 Drawing Sheets

DAMPER LOCKING MECHANISM FOR TOILET SEAT

CROSS REFERENCE TO RELATED APPLICATIONS

This application claims the benefit of U.S. Provisional Application No. 61/750,135 filed on Jan. 8, 2013, which is hereby incorporated by reference in its entirety.

BACKGROUND

The present application relates generally to the field of toilets. More specifically, the present application relates to an improved damper locking mechanism for influencing the inertia of a toilet seat relative to a toilet bowl to which the seat is coupled.

Damper locking mechanisms are provided on toilets to influence the inertia of the toilet seat when being moved, such as when the toilet seat is moved from an up (e.g., open) position to a down (e.g., closed) position. For example, the damper locking mechanism may resist a change in movement of the toilet seat from the up to the down position by exerting a force that resists closing the toilet seat to thereby slow the closing and prevent the toilet seat from slamming on the toilet bowl.

One problem associated with damper locking mechanisms is an inherent looseness between a damper body and a bore of the hinge, which can result in looseness between the toilet seat (coupled to the damper) and the toilet bowl (coupled to the housing). This looseness is inherent with the tolerances required to accommodate the manufacturing processes for the damper and hinge components.

Some embodiments of conventional damper locking mechanisms may include a hinge base coupled to the toilet bowl and fixed thereto. The hinge base includes a bore defined by an opening in a side wall of the hinge base, where the bore is configured to receive a damper. The damper must be retracted, then advanced back into a seat of the toilet for engagement. To reduce seat movement, the damper locking mechanism may include crush ribs to eliminate the clearance between the damper and the hinge base. The crush ribs may extend along the sides of the bore for a part of or an entire length of the hinge base. The crush ribs are positioned so that they are permanently deformed within the hinge base when the damper is inserted. When the damper is inserted into the hinge base, the crush ribs are torn from the side walls of the bore and the remaining crush rib material reduces movement of the damper within the hinge base. However, because the damper must be retracted, then advanced into the arms, the crush ribs have less contact with the damper and rotational movement remains due to lost contact with the deformed crush rib material. The movement within the hinge base and the damper can be perceived as a loose seat.

Other embodiments of conventional damper locking mechanisms may include a hinge base coupled to the toilet bowl and fixed thereto. The hinge base includes a bore defined by an opening in a side wall of the hinge base, where the bore is configured to receive a damper. For example, the damper may include a damper body that engages the bore and an arm that extends from the damper body. The arm is pivotally connected to the damper body, such that the arm rotates relative to the damper body with an influenced (e.g., dampened) inertia. Accordingly, the arm of the damper is coupled to a toilet seat and the body of the damper is coupled to the hinge base to allow the toilet seat to rotate relative to the toilet bowl with an inertia that is influenced through the damper. A conventional way of retaining the body of the damper, so that the arm is able to rotate relative to the damper body, is by having a key-way feature in the bore of the hinge base and a mating key-way in the damper body to thereby restrict relative rotation between the body and the hinge base. For example, the bore may include grooves that are aligned at various radial locations around the bore, where each groove may receive a corresponding spline (e.g., projection) that extends outwardly from the body of the damper. The engagement between the splines of the body of the damper and the grooves of the hinge base prevent relative rotation between the body and the hinge base. However, there is clearance between the splines and the grooves due to manufacturing tolerances, which creates looseness between the body of the damper and the bore.

The present application relates to a damper locking mechanism for a toilet that allows the toilet seat (and/or cover) to rotate relative to the toilet bowl with an influenced (e.g., dampened) inertia, wherein the mechanism is configured to address the issue of looseness discussed above (i.e., the mechanism is configured to reduce or remove the looseness between the damper and the hinge base) and other issues associated with damper locking mechanisms.

SUMMARY

An exemplary embodiment relates to a toilet including a seat, a bowl, and a damper locking mechanism configured to allow the seat to rotate relative to the bowl with an influenced inertia. The damper locking mechanism includes a hinge base having a biasing member and an interior surface that defines a bore and a damper having an exterior surface that engages the interior surface. When the damper is disposed in the bore, the biasing member imparts a radial force to bias the damper into the hinge base and remove a looseness between the seat and the bowl.

Another exemplary embodiment relates to a damper locking mechanism for a toilet. The damper locking mechanism includes a hinge base having a biasing member and an interior surface that defines a bore and a damper having an exterior surface that engages the interior surface. When the damper is disposed in the bore, the biasing member imparts a radial force to bias the damper into the hinge base.

Yet another exemplary embodiment relates to a method for removing a looseness between a toilet seat and a toilet bowl through a damper locking mechanism. The method includes the steps of providing a hinge base having a biasing member and an interior surface that defines a bore, disposing a damper within the bore such that an exterior surface of the damper engages the interior surface, and imparting, by the biasing member, a radial force to bias the damper into the hinge base and remove a looseness between the toilet seat and the toilet bowl.

DETAILED DESCRIPTION

Figure 11:
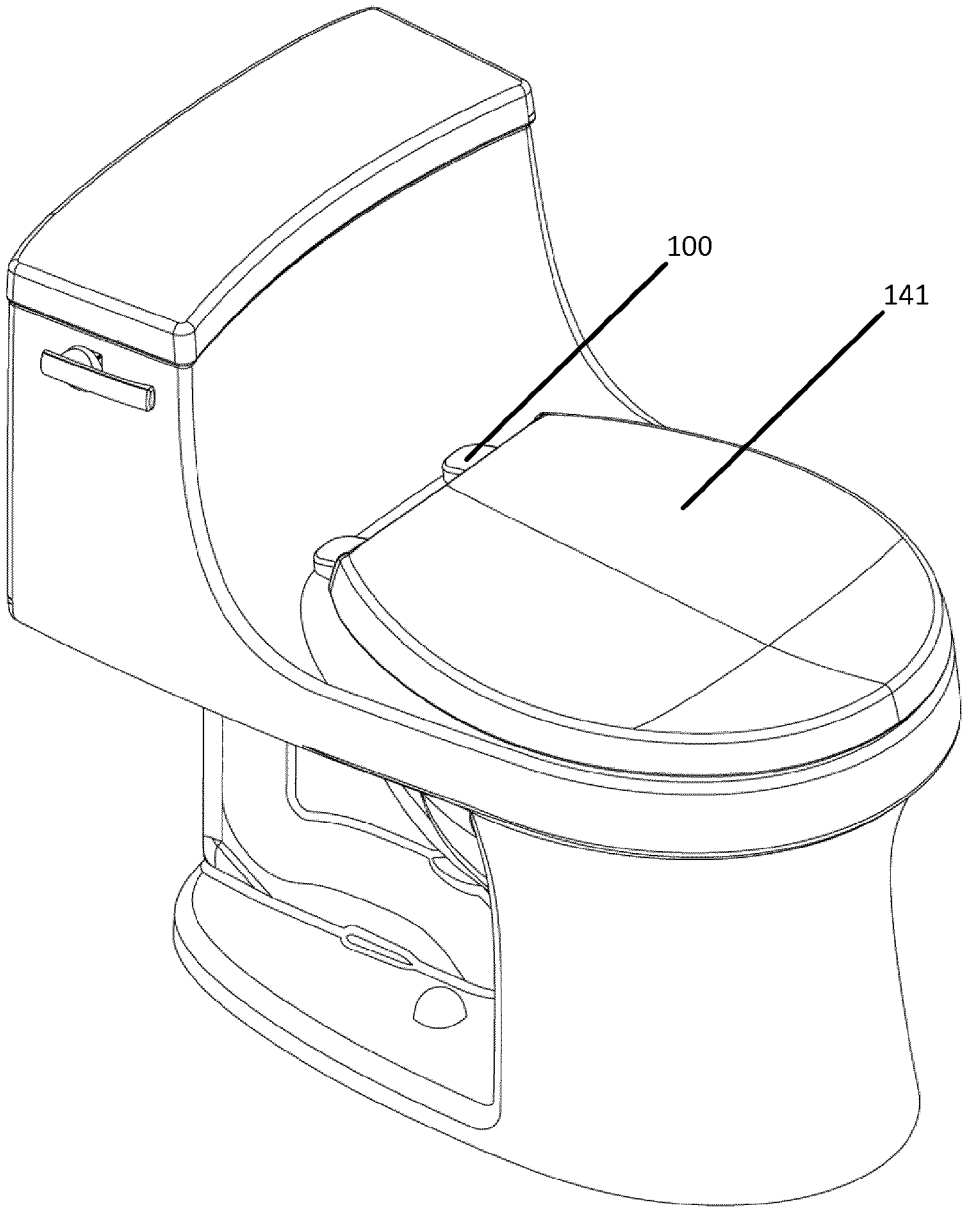
FIG. 11 is a perspective view of a toilet including the damper locking mechanism according to the embodiment of FIG. 1, with a seat cover closed.
Figure 12:
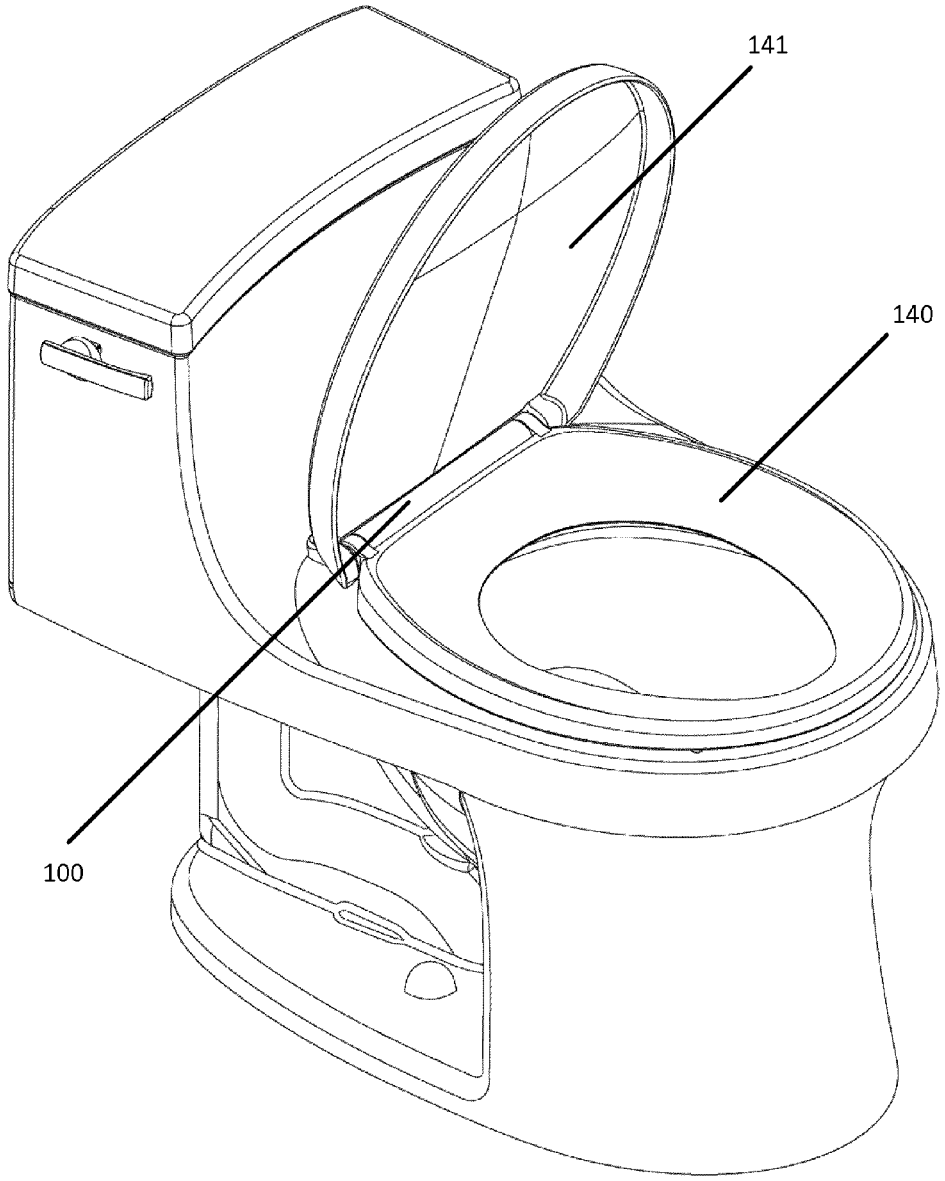
FIG. 12 is a perspective view of a toilet including the damper locking mechanism according to the embodiment of FIG. 1, with a seat cover opened.

FIGS. 1-4 illustrate an exemplary embodiment of a damper locking mechanism 100 including at least one hinge base 110, at least one damper 120, and a housing 130. The damper locking mechanism 100 may be an element incorporated into a design of a toilet to allow a toilet seat 140 (and/or cover 141) to rotate relative to a toilet bowl with an influenced inertia (see FIGS. 11 and 12). The damper locking mechanism 100 is configured to reduce or remove a looseness between the hinge base 110 and the damper 120 such that a user does not perceive a movement of the damper 120 within the hinge base 110 as a loose seat 140 and/or cover 141.

In an exemplary embodiment (see FIGS. 1-4), damper locking mechanism 100 includes two hinge bases 110, a right side hinge base 110A and a left side hinge base 110B disposed at opposite ends of the damper locking mechanism 100. A housing 130 covers an entire length of the damper locking mechanism 100. The right and the left side hinge bases 110A, 110B are operated according to a same procedure and include similar individual elements, but the individual elements of the right and the left side hinge bases 110A, 110B are disposed within the damper locking mechanism 100 as mirror images of each other. In other words, the right side hinge base 110A is a mirror image of the left side hinge base 110B. Although a single hinge base 110 is described below, the elements of and method for operating the single hinge base 110 correspond to the elements of and method for operating both the right and the left side hinge bases 110A and 110B.

Referring now to FIGS. 4-7, the hinge base 110 includes a bore 111 defined by an inner wall 112 of the hinge base 110. The bore 111 extends through an entire length of the hinge base 110. A plurality of grooves 113 are provided on an inner surface of the bore 111. In an exemplary embodiment, six grooves 113A-113F are provided on the inner surface of the bore 111. In other embodiments, a different number of grooves 113 may be provided. The grooves 113A-113F are substantially symmetrically distributed about a central axis defined from a top of the hinge base 110 to a bottom of the hinge base 110. The bore 111 is configured to receive a portion (e.g., a body) of the damper 120.

Figure 1:
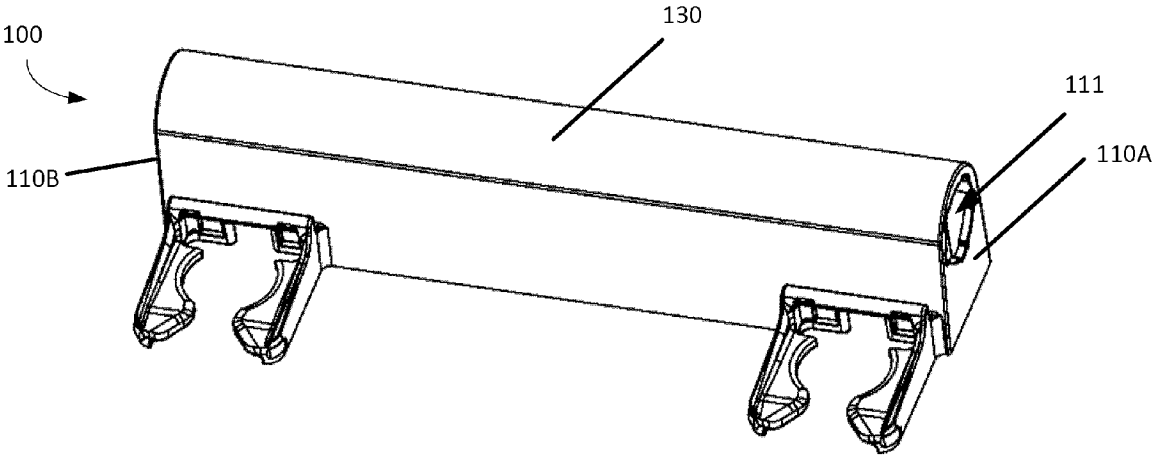
FIG. 1 is a top perspective view of an exemplary embodiment of a damper locking mechanism having arms to couple the damper locking mechanism to a toilet seat and/or cover.
Figure 2:
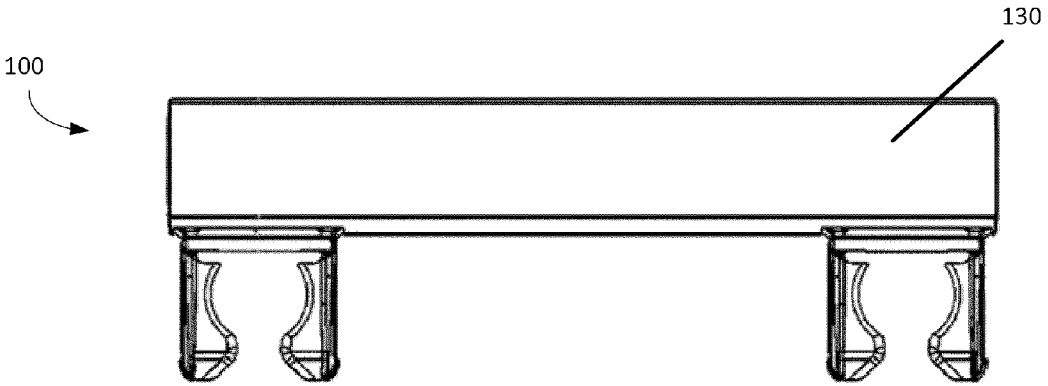
FIG. 2 is a top view of the damper locking mechanism according to the embodiment of FIG. 1.
Figure 3:
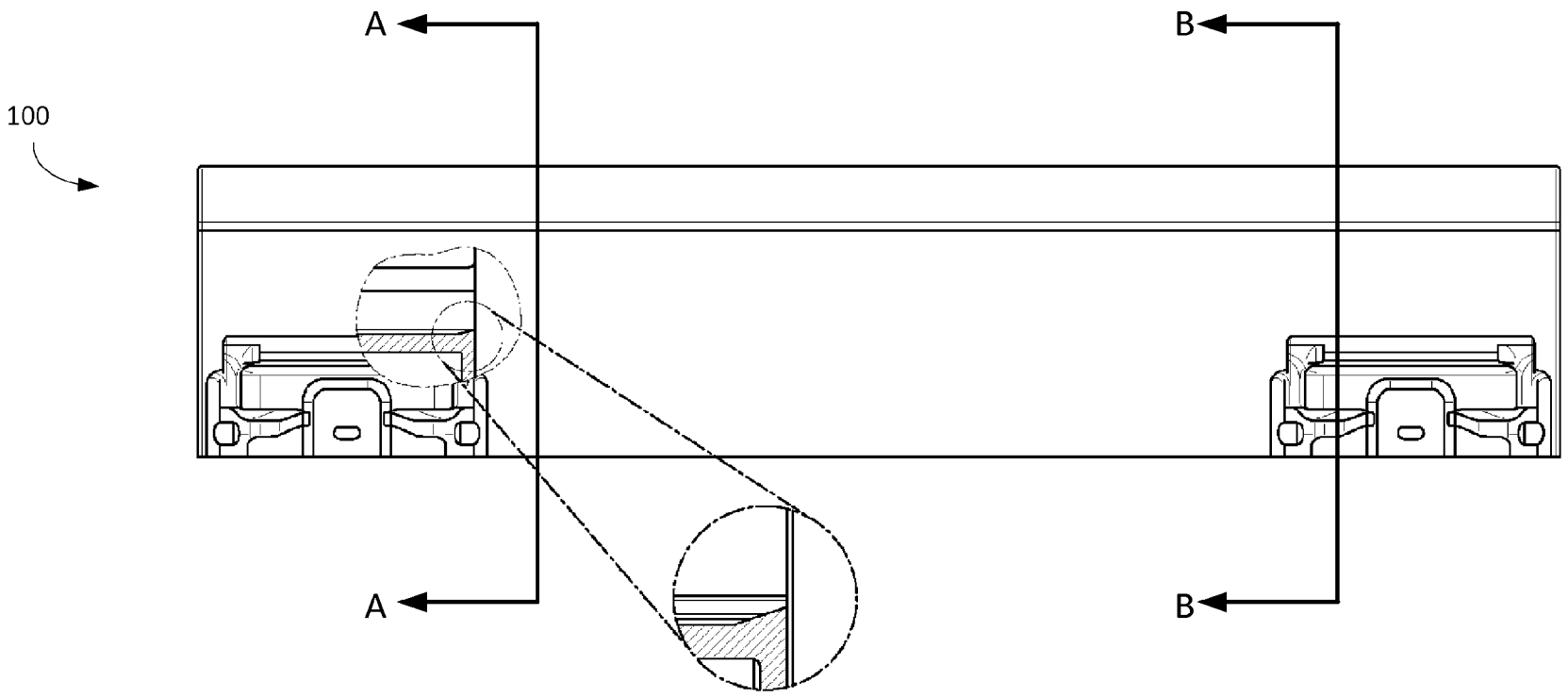
FIG. 3 is front view of the damper locking mechanism according to the embodiment of FIG. 1.
Figure 4:
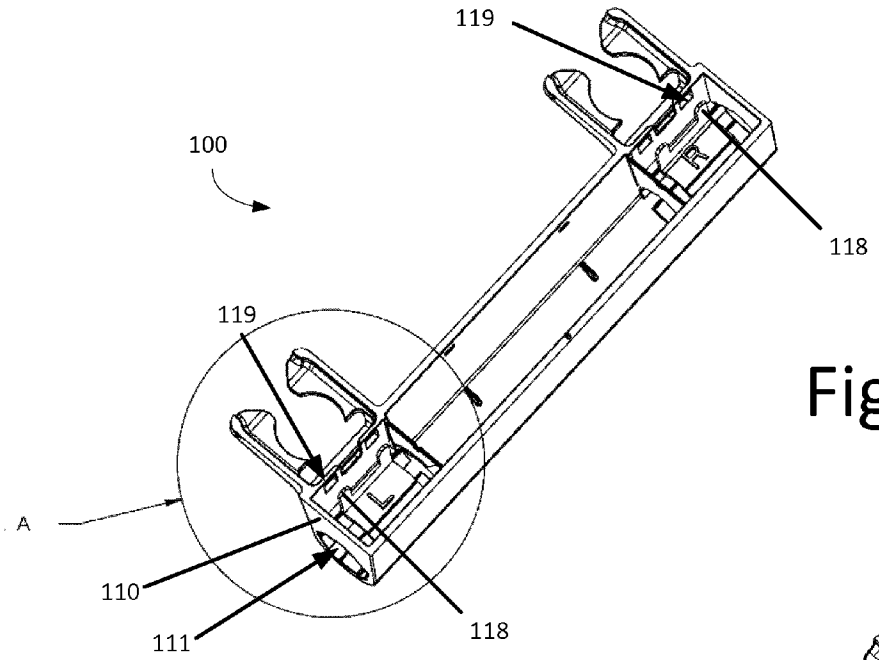
FIG. 4 is a bottom perspective view of a left side hinge base and a right side hinge base of the damper locking mechanism according to the embodiment of FIG. 1.
Figure 5:
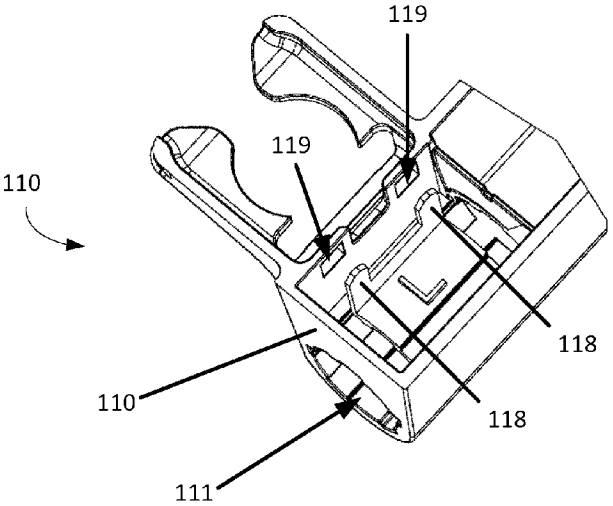
FIG. 5 is bottom perspective view of the left side hinge base of the damper locking mechanism according to the embodiment of FIG. 4.
Figure 6:
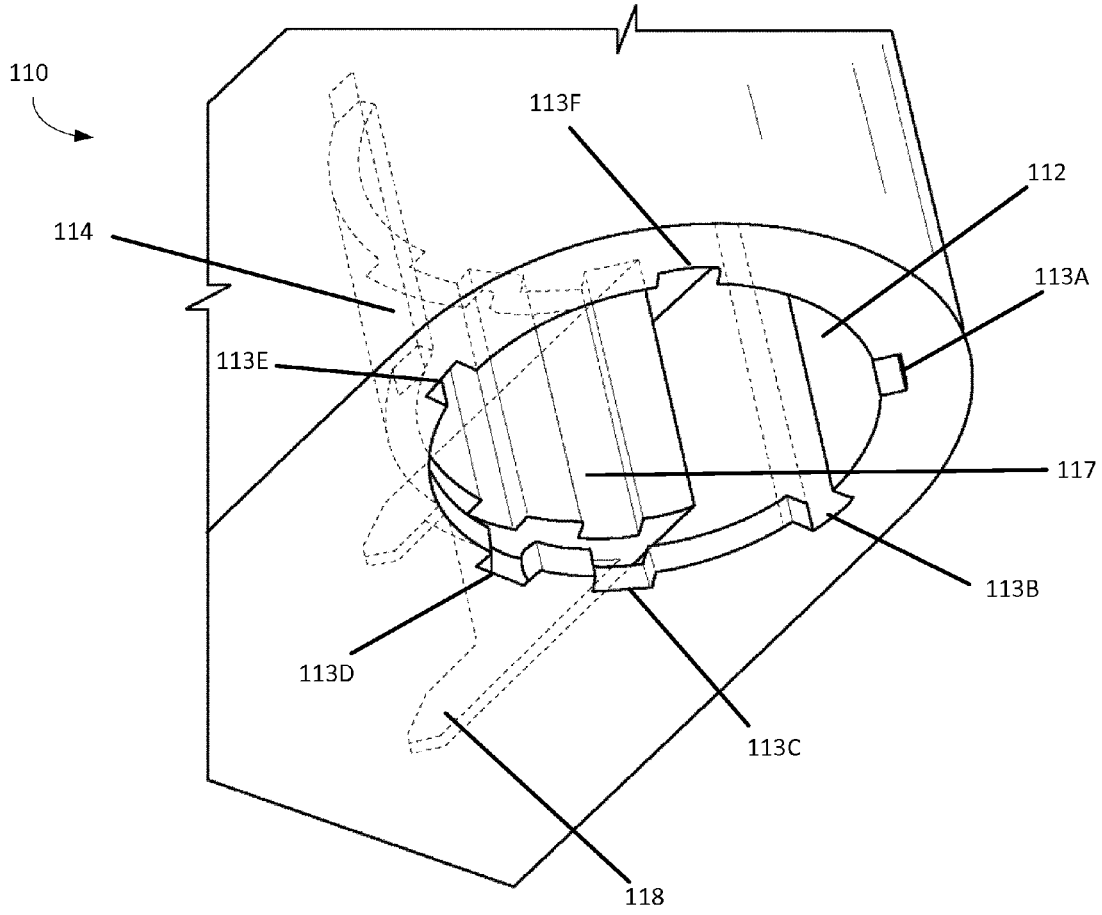
FIG. 6 is a top perspective view of the right side hinge base of the damper locking mechanism according to the embodiment of FIG. 4.
Figure 7:
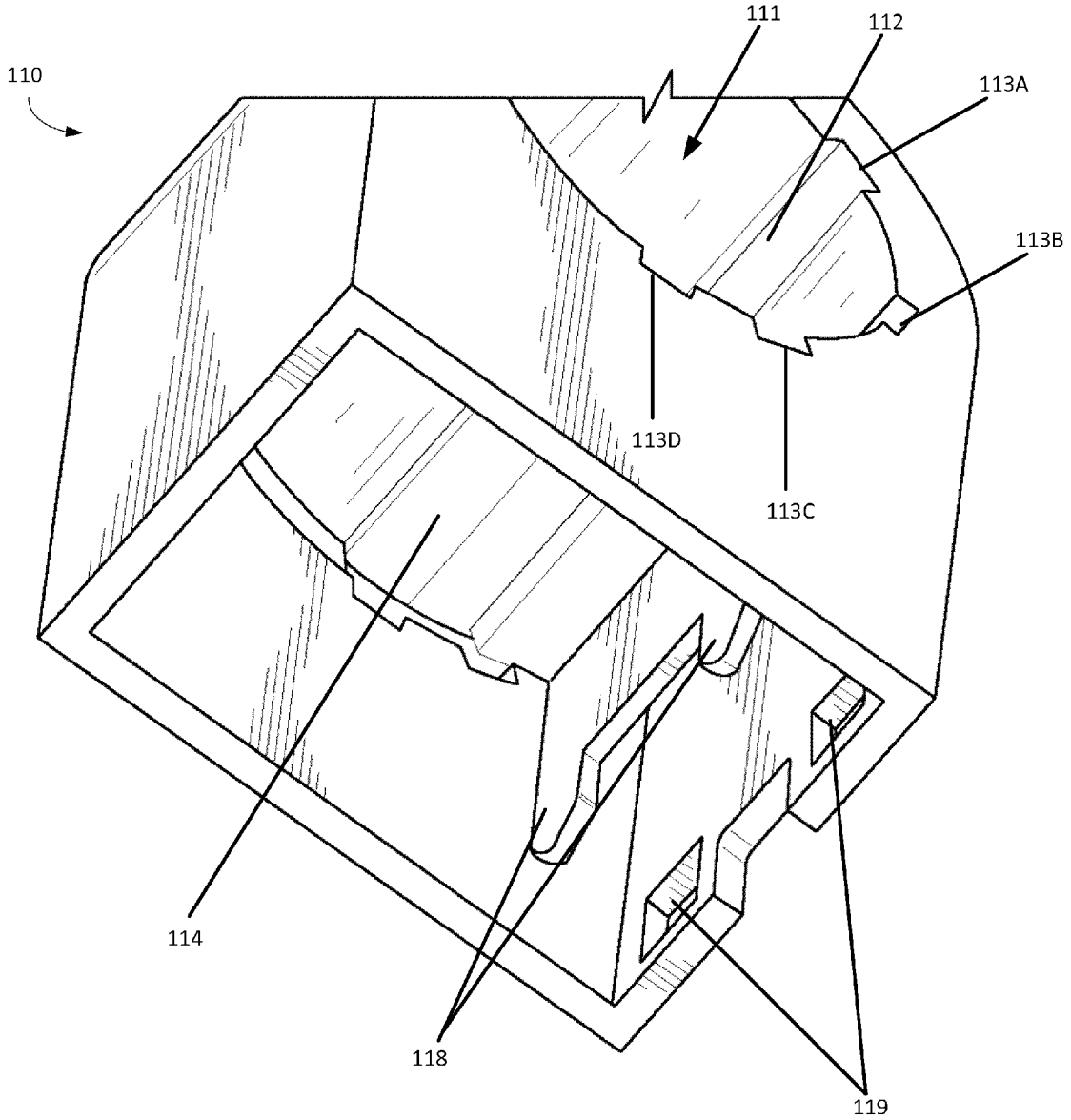
FIG. 7 is a bottom perspective view of the left side hinge base according to the embodiment of FIG. 4.
Figure 8:
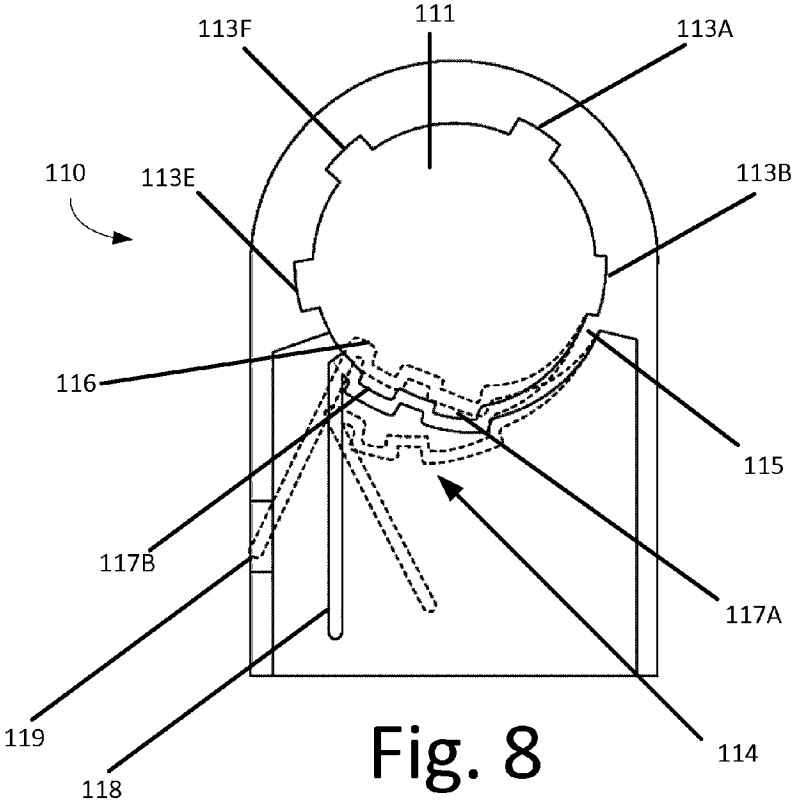
FIG. 8 is a side cross-sectional view of the left side hinge base through a line A-A of FIG. 3.

Referring now to FIGS. 6-8, the hinge base 110 further includes a biasing member 114 disposed within the bore 111. The biasing member 114 is configured to move relative to the inner wall 112 defining the bore 111 such that the biasing member 114 clamps the body of the damper 120 in place to remove the looseness between the hinge base 110 and the damper 120. The biasing member 114 is defined in part by a fixed end 115 and a distal end 116 with a contoured surface 117 disposed between the fixed end 115 and the distal end 116. The contoured surface 117 includes grooves 117A and 117B that correspond in size and position to grooves 113C and 113D on the inner surface of the bore 111. The biasing member 114 is able to pivot from the fixed end 115 to move toward the body of the damper 120 disposed in the bore 111 to thereby move the biasing member 114 relative to the bore 111 to a biased position in which a radial force is applied to the body of the damper 120. When the damper 120 is fully engaged to the seat 140, the grooves 113A-F remain intact with the damper 120. Thus, if the contoured surface 117 ever loses retention, for example, in a case of biasing member 114 fatigue, the damper locking mechanism 100 will still be capable of performing full damping functions.

The distal end 116 of the biasing member 114 includes at least one extension member 118. The extension member 118 extends away from the bore 111. The at least one extension member 118 is configured to engage with a hole 119 in the hinge base 110. The hole 119 is disposed on a side surface of the hinge base 110 that is not traversed by the bore 111. According to an exemplary embodiment, the biasing member 114 includes two parallel extension members 118, 118 and two holes 119, 119. The extension members 118, 118 are disposed at a predetermined distance from each other, corresponding to the distance between the holes 119, 119. When the extension member 118 does not engage with the hole 119, the biasing member 114 is in a free or unbiased position. FIG. 8 illustrates the biasing member 114 in the unbiased position through a solid line and further illustrates the biasing member in various biased positions through broken lines. When the extension member 118 engages with the hole 119 such that the extension member 118 is retained within the hole 119 in a biased, locked position (see FIG. 10), the extension member causes the contoured surface 117 of the biasing member 114 to bow under load, thereby applying and maintaining a radial force on the damper 120 until the extension member 118 is removed from the hole 119.

In an exemplary embodiment, the at least one extension member 118 may include a racheting (i.e., teeth-like) engagement to the hinge base 110 by virtue of the hole 119 having teeth-like members. This configuration is similar to that of a tie strap-type engagement.

In another exemplary embodiment, the hole 119 may provide access to another feature or element, for example, an actuator (not illustrated). In another exemplary embodiment, the actuator may provide the force that drives the extension member 118 to create the radial force in the biasing member 114 that clamps the body of the damper 120.

Figure 9:
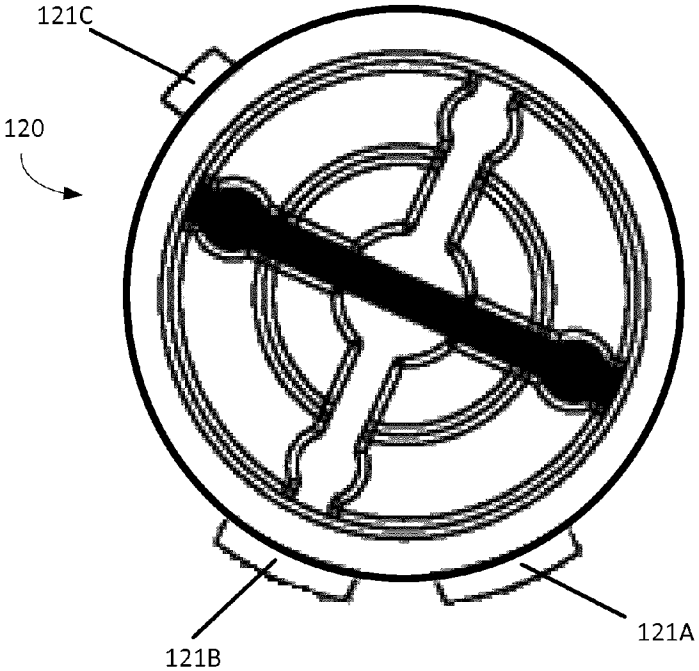
FIG. 9 is side view of an exemplary embodiment of a damper of the damper locking mechanism according to the embodiment of FIG. 1.

Referring now to FIG. 9, the damper 120 includes a plurality of splines 121 extending from an exterior surface of the body of the damper 120. The splines 121 are configured to engage with the grooves 113 of the hinge base 110 and the grooves 117 of the biasing member 114 to prevent relative rotation between the bore 111 and the body of the damper 120. The splines 121 on the exterior surface of the damper 120 preferably extend an length of the damper 120. In one embodiment (not illustrated), the splines 121 may have the same width, and are evenly spaced about a circumference of the damper 120. According to an exemplary embodiment, the damper 120 includes three splines 121: a first spline 121A and a second spline 121B configured to engage with the biasing member 114 of the hinge base 110 and a third spline 121C configured to engage with the groove 113F on the interior surface of the bore 111. In one embodiment, the first, second and third splines 121A-121C may have the same width. In another embodiment, the first and the second splines 121A, 121B have a width greater than a width of the third spline 121C. In other exemplary embodiments, the damper 120 may include a spline 121 for each groove 113 provided on the interior surface of the bore 111. The number of splines 121 and the width of each spline 121 may be reduced in order to reduce an amount of material necessary to fabricate the damper 120 and thus, reduce the cost associated with fabricating the damper 120.

Figures 13A, 13B:
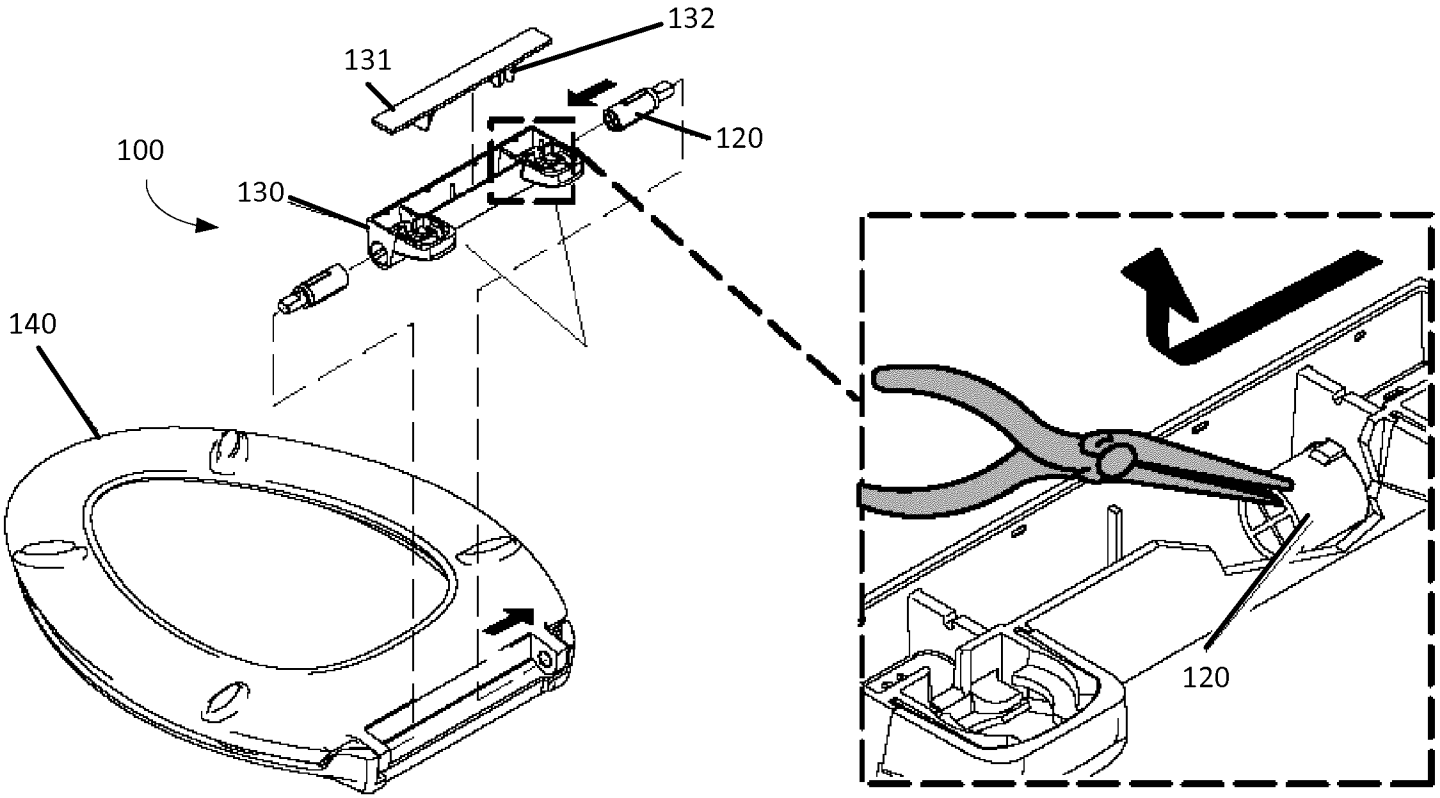
FIG. 13A is an exploded view of the damper locking mechanism according to the embodiment of FIG. 1, prior to installation.
FIG. 13B is a perspective view of a damper of the damper locking mechanism according to the embodiment of FIG. 1, with the damper engaged with a toilet seat.

The damper 120 may also include an arm (not illustrated) extending from the body of the damper 120. The arm is pivotally connected to the damper 120, such that the arm rotates relative to the body of the damper 120 with an influenced (e.g., dampened) inertia. The arm of the damper 120 may be coupled to a toilet seat 140 and/or cover 141 while the body of the damper 120 is coupled to the hinge base 110 to allow the toilet seat 140 and/or cover 141 to rotate relative to a toilet bowl with an inertia that is influenced through the damper 120. The damper 120 must be retracted, then advanced back into the toilet seat 140 and/or cover 141 for engagement. As illustrated in FIGS. 13A and 13B, the whole damper 120 retracts and advances into the toilet seat 140 and/or cover 141.

Figure 10:
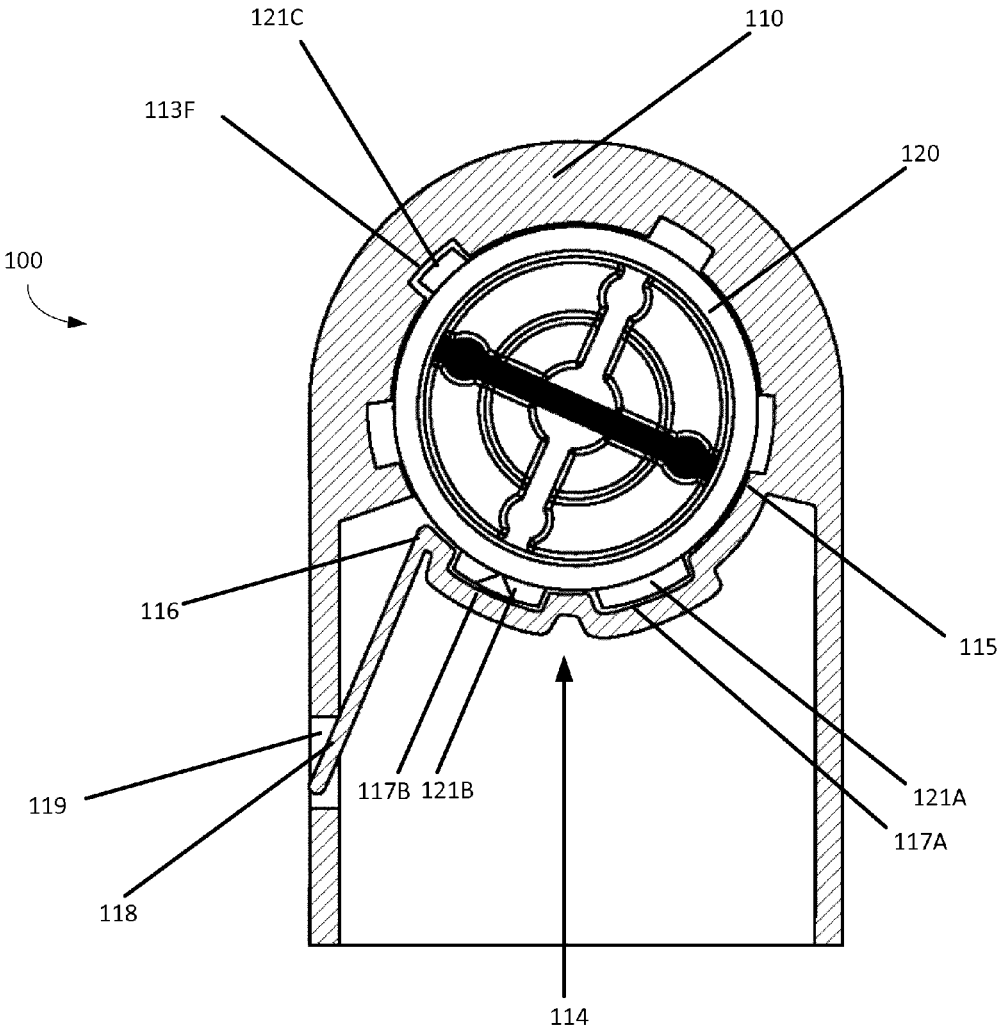
FIG. 10 is a side cross-sectional view of the damper of FIG. 9 inserted in the right side hinge base through a line B-B of FIG. 3.

Referring now to FIG. 10, a method for operating the damper locking mechanism 100 will now be discussed. The damper locking mechanism 100 (as described above) is provided as an element of a toilet design. When the toilet seat 140 and/or cover 141 are closed such that the toilet seat 140 and/or cover 141 are substantially parallel to the upper surface of the toilet bowl, the damper locking mechanism 100 is in the free, unbiased position. When a user opens the toilet seat 140 and/or cover 141 toward a position in which the toilet seat 140 and/or cover 141 is substantially perpendicular to the toilet bowl, the damper locking mechanism 100 is in the locked, biased position. As the toilet seat 140 and/or cover 141 is raised from the closed to open position, the arm of the damper 120 is advanced into the toilet seat 140 and/or cover 141.

As the toilet seat 140 and/or cover 141 is raised, the biasing member 114 pivots about the fixed end 115, causing the contoured surface 117 to force against the splines 121 of the damper 120. This force causes the damper 120 to rotate in the hinge base 110. Rotation of the damper 120 within the hinge base 110 is limited within the grooves 113 of the hinge base 110. In a full open position of the toilet seat 140 and/or cover 141, the spline 121C of the damper 120 rests within the groove 113F of the hinge base 110 and the grooves 117A and 117B of the biasing member engage with the splines 121A and 121B, respectively, of the damper 120. Portions of the contoured surface 117 in which grooves are not disposed force against the body of the damper 120. This force causes the damper 120 to move against the hinge base 110 within the bore 111. According to this configuration, the body and the splines 121 of the damper 120 will be held in place by the clamping force imparted by the biasing member 114 and the clearance between the hinge base 110 and the damper 120 may be reduced or removed.

When the toilet seat 140 and/or cover 141 is in the full open position, the extension member 118 of the biasing member 114 is received by the hole 119 of the hinge base 110, clamping or locking the damper 120 into the hinge base 110 by radial force. The engagement of the extension member 118 is in a bending load and acts in a "bow" condition. The bowing allows the biasing member 114 to retain engagement onto the damper 120 while the damper 120 is advanced within the toilet seat 140 and/or cover 141. When the extension member 118 is received in the hole 119, a force concentration or point loading is created on the extension member 118. The housing 130 covers the hinge base 110 and retains the damper 120 to maintain engagement (i.e., advancement) into the arms of the seat 140 and/or cover 141. As illustrated in FIGS. 13A and 13B, the housing 130 includes a housing cover 131 having webs 132 configured to retain the damper 120 in an engaged position. In order to disengage the seat 140 from the hinge base 110, the housing cover 131 must be removed and the damper 120 must be pulled back.

When the toilet seat 140 and/or cover 141 are moved from the open to the closed position, the damper 120 is retracted from the toilet seat 140 and/or cover 141 and the extension member 118 is removed from the hole 119. Removal of the extension member 118 removes the radial force imparted by the biasing member 114 and unlocks or relieves the clamping of the damper 120 to the hinge base 110 and allows the seat 140 to rotate relative to the base under the inertial influence of the damper.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the toilets and attachment assemblies or systems as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A toilet comprising:

a seat;

a bowl; and a damper locking mechanism configured to allow the seat to rotate relative to the bowl with an influenced inertia, the damper locking mechanism comprising:

a hinge base having a biasing member and an interior surface that defines a bore; and a damper having an exterior surface that engages the interior surface, wherein the biasing member comprises a fixed end affixed to the interior surface of the hinge base, a distal end, and a contoured surface disposed between the fixed end and the distal end, wherein when the damper is disposed in the bore, the contoured surface of the biasing member contacts the exterior surface of the damper and imparts a radial force to bias the damper into the hinge base and remove a looseness between the seat and the bowl.

2. The toilet of claim 1, wherein a plurality of grooves are disposed on the interior surface of the hinge base and a plurality of splines are disposed on the exterior surface of the damper.

3. The toilet of claim 2, wherein at least one spline disposed on the exterior surface of the damper is configured to engage with a groove disposed on the interior surface of the hinge base, and a rotation of the damper is limited within the plurality of grooves.

4. The toilet of claim 1, wherein the biasing member is configured to pivot about the fixed end relative to the interior surface of the hinge base.

5. The toilet of claim 1, wherein the biasing member further comprises at least one extension member extending away from the bore, and the hinge base comprises at least one hole disposed on a surface of the hinge base that is not traversed by the bore, wherein the at least one hole is configured to receive and secure the at least one extension member.

6. The toilet of claim 5, wherein when the at least one hole receives and secures the at least one extension member, the contoured surface of the biasing member is configured to engage with at least one spline disposed on the exterior of the damper such that the radial force is applied to the damper to secure the damper to the hinge base and remove a clearance between the damper and the hinge base.

7. The toilet of claim 6, wherein the radial force is removed by releasing the at least one extension member from the at least one hole.

8. A damper locking mechanism for a toilet, comprising:

a hinge base having a biasing member and an interior surface that defines a bore; and a damper having an exterior surface that engages the interior surface;

wherein the biasing member comprises a fixed end affixed to the interior surface of the hinge base, a distal end, and a contoured surface disposed between the fixed end and the distal end, and wherein when the damper is disposed in the bore, the contoured surface of the biasing member contacts the exterior surface of the damper and imparts a radial force to bias the damper into the hinge base.

9. The damper locking mechanism of claim 8, wherein a plurality of grooves are disposed on the interior surface of the hinge base and a plurality of splines are disposed on the exterior surface of the damper.

10. The damper locking mechanism of claim 9, wherein at least one spline disposed on the exterior surface of the damper is configured to engage with a groove disposed on the interior surface of the hinge base, and a rotation of the damper is limited within the plurality of grooves.

11. The damper locking mechanism of claim 8, wherein the biasing member is configured to pivot about the fixed end relative to the interior surface of the hinge base.

12. The damper locking mechanism of claim 8, wherein the biasing member further comprises at least one extension member extending away from the bore and the hinge base comprises at least one hole disposed on a surface of the hinge base that is not traversed by the bore, the at least one hole configured to receive and secure the at least one extension member.

13. The damper locking mechanism of claim 12, wherein when the at least one hole receives and secures the at least one extension member, the contoured surface of the biasing member engages with at least one spline disposed on the exterior of the damper such that the radial force is applied to the damper to secure the damper to the hinge base.

14. The damper locking mechanism of claim 13, wherein the radial force is removed by releasing the at least one extension member from the at least one hole.

15. A method of removing a looseness between a toilet seat and a toilet bowl through a damper locking mechanism, the method comprising:

providing a hinge base having a biasing member and an interior surface that defines a bore, the biasing member comprising a fixed end affixed to the interior surface of the hinge base, a distal end, and a contoured surface disposed between the fixed end and the distal end;

disposing a damper within the bore such that an exterior surface of the damper engages the interior surface; and imparting, by contacting the contoured surface of the biasing member with the external surface of the damper, a radial force to bias the damper into the hinge base and remove a looseness between the toilet seat and the toilet bowl.

16. The method of claim 15, wherein the disposing step comprises:

engaging at least one spline disposed on the exterior surface of the damper with at least one of a plurality of grooves disposed on the interior surface of the hinge base; and limiting a rotation of the damper within the plurality of grooves.

17. The method of claim 15, wherein the biasing member is configured to pivot about the fixed end relative to the interior surface of the hinge base.

18. The method of claim 15, wherein the biasing member further comprises at least one extension member extending away from the bore, and the hinge base comprises at least one hole disposed on a surface of the hinge base that is not traversed by the bore, and imparting the radial force to bias the damper into the hinge base comprises receiving and securing the at least one extension member within the at least one hole.

19. The method of claim 18, wherein when the at least one hole receives and secures the at least one extension member, the contoured surface of the biasing member engages with at least one spline disposed on the exterior of the damper such that the radial force is applied to the damper to secure the damper to the hinge base.

20. The method of claim 18, wherein the radial force is removed by releasing the at least one extension member from the at least one hole.

* * * * *